US011476597B1

(12) United States Patent
Hedgepeth

(10) Patent No.: US 11,476,597 B1
(45) Date of Patent: Oct. 18, 2022

(54) GROUND ROD CONNECTOR

(71) Applicant: Destry Ray Hedgepeth, Enfield, NC (US)

(72) Inventor: Destry Ray Hedgepeth, Enfield, NC (US)

( * ) Notice: Subject to any disclaimer, the term of this patent is extended or adjusted under 35 U.S.C. 154(b) by 0 days.

(21) Appl. No.: 17/238,668

(22) Filed: Apr. 23, 2021

(51) Int. Cl.
*H01R 4/00* (2006.01)
*H01R 4/66* (2006.01)

(52) U.S. Cl.
CPC ..... *H01R 4/66* (2013.01)

(58) Field of Classification Search
CPC ..... H01R 4/66
See application file for complete search history.

(56) References Cited

U.S. PATENT DOCUMENTS 4,887,970 A * 12/1989 den Hartog ..... H01R 4/66 174/7
5,364,281 A * 11/1994 Leto ..... H01R 4/60 439/100
5,542,479 A * 8/1996 Stachler ..... B25D 1/16 173/132
6,040,522 A * 3/2000 Beggs ..... H01R 4/66 362/431
6,979,207 B2 * 12/2005 Wenger ..... H01R 4/5041 439/100
2018/0019526 A1 * 1/2018 Stilwell ..... H02G 13/40

FOREIGN PATENT DOCUMENTS

CA 1118060 2/1982
WO PCT/US97/02236 8/1997

* cited by examiner

*Primary Examiner* — Pete T Lee

(74) *Attorney, Agent, or Firm* — James G. Passé; Passé Intellectual Property, LLC

(57) ABSTRACT

An easily removable ground rod connector system for attaching grounding wires to a ground rod, which can be easily added to or removed from the ground rod even after the ground rod has been inserted into the ground and ultimately provides a safe and reliable connection and corrects several existing problems with current connectors.

3 Claims, 1 Drawing Sheet

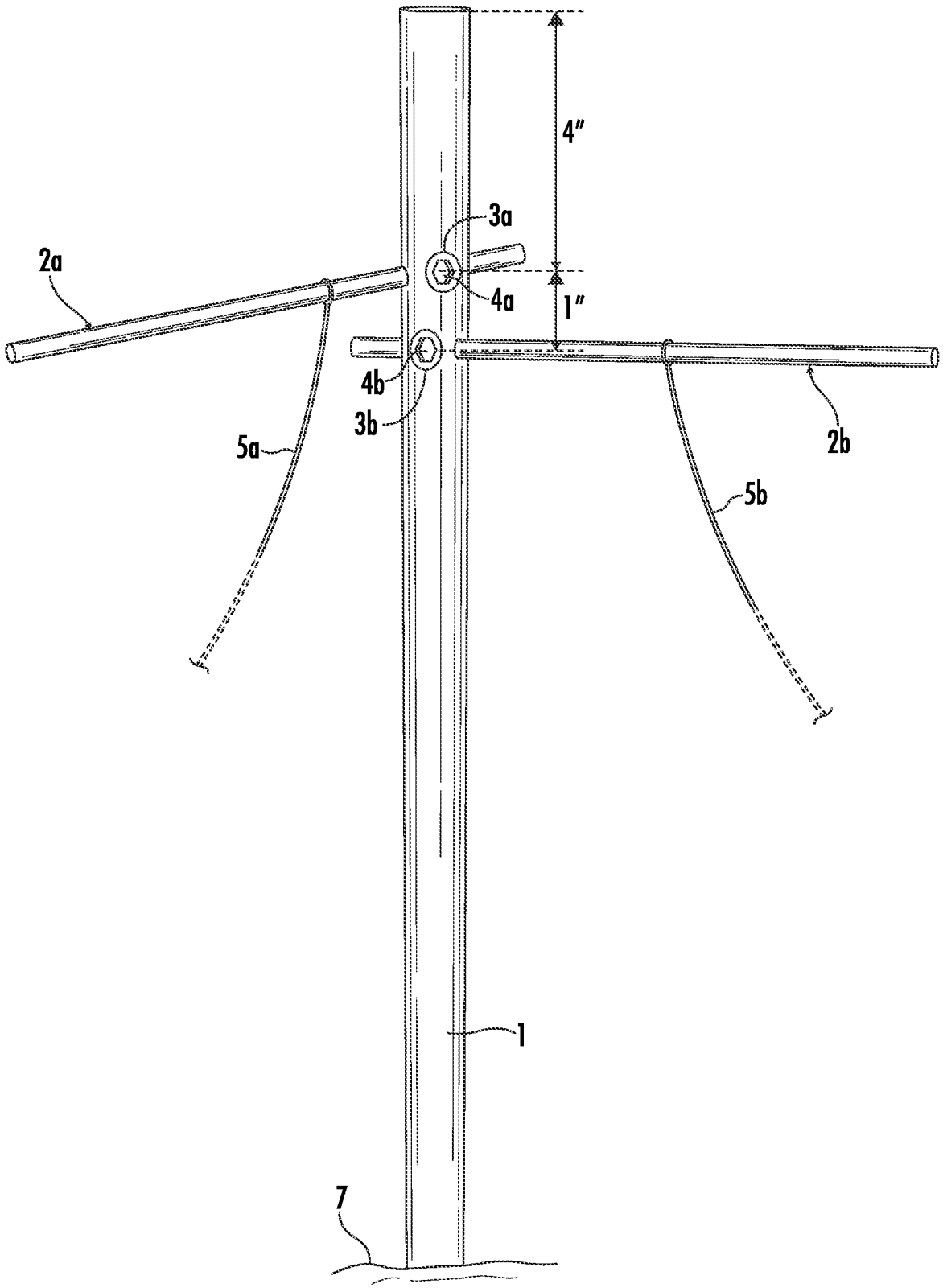
4"
3a
2a
4a
1"
4b
3b
5a
2b
5b
1
7

GROUND ROD CONNECTOR

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a ground rod and a ground rod connector for attaching grounding wires. In particular, it relates to an easily removable connector which can easily be added to the ground rod or removed, even after the ground rod has been inserted into the ground.

Description of Related Art

A ground rod is a rigid metal bar that is electrically grounded, usually by being driven into the ground to a predetermined depth. Ground rods are used extensively in the building trade to establish an electrical ground for the structure being built. Grounding wires for the structure are then attached to the ground rod to establish an electrical ground. The attachment usually comes in the form of a connector, which is attached to the ground rod that grounding wires in turn are attached to.

There are a number of different devices that are used as ground rod connectors. The current connectors, however, suffer from a number of problems. First, the connector must be in contact with both the ground rod and the connectors. Currently, they are connected by a means that can loosen over time, which will result in the unreliable and inadequate connection to the grounding wire attached to the ground rod. Secondly, many of the devices attach at the top of the ground rod. That means they must be attached to the ground rod before it is driven into the ground. The process of driving a ground rod into the ground (usually with a sledge hammer) flattens and expands the top of the ground rod, making it impossible to get the connector onto the ground rod. Having a connector on the rod during ground insertion can easily lead to inadvertently damaging the ground rod connector. Lastly, many connectors suffer from not being able to accommodate thermal expansion and contraction, again, leading to an unreliable ground connection. There is clearly a need for improvement in ground rod connectors.

BRIEF SUMMARY OF THE INVENTION

The present invention provides a reliable ground connection that can be used either before or after the ground rod is inserted into the ground, provides an easy to use connection to the grounding wires, and provides reliable and adequate electrical contact between the ground rod and the ground rod connector.

Accordingly, in one embodiment, there is a system for attaching grounding wires to a ground rod comprising:

a) a solid ground rod having a selected diameter;

b) one or more conductive rods with a selected diameter;

c) one hole through the diameter of the ground rod for each conductive rod utilized, wherein the diameter of each hole is less than the diameter of the ground rod and greater than the diameter of the conductive rod; and d) wherein the conductive rods are positioned through each of the holes in the diameter of the ground rod and each conductive rod is held in place by a set screw.

BRIEF DESCRIPTION OF THE DRAWINGS

FIG. 1 is a frontal view of the system of the present invention with grounding wires attached to the conductive rods.

DETAILED DESCRIPTION OF THE INVENTION

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "ground rod" refers to a rod that is inserted into the ground in order to provide electrical connection to the ground to carry current safely away from a circuit (grounding wires) in the event of an electrical surge. A ground rod generally is solid copper, aluminum, a combination thereof, or other highly conductive material. It may be a copper dad metal rod, stainless steel, or a galvanized iron rod. The ground rod normally is at least 8 feet long and will have a diameter of at least 15.87 mm. In the present invention, a hole is placed through the diameter of the ground rod anywhere, that once installed in the ground is located above the ground. In one embodiment, the holes are positioned in the upper 25% of the rod. If more than one conductive rod is utilized, there will be one hole for each conductive rod. The holes should have a diameter larger than the conductive rods. In one embodiment, the diameter is such that the insertion of the conduction rod is a tight fit.

As used herein, the term "grounding wire" refers to a wire that has an electrical connection to the earth through another grounded conductor (ground rod) and is attached to a circuit or object that needs grounding, and wherein the ground or earth is the reference point in an electrical circuit from which voltages are measured, provides a common return path for electric current, or provides a direct physical connection to the earth. Electrical circuits may be connected to the ground for several reasons. The grounding wire can be attached conductively to the conductive rods by any method for attaching wire to a metal rod. There may be one or more grounding wires attached to one or more conductive rods.

As used herein, the term "conductive rod" refers to a rod (in one embodiment, a circular, cross section rod) of a highly conductive metal such as copper, silver, stainless steel, and aluminum. In one embodiment, the set screw is a bolt which passes through a side of the ground rod to the conductive rod.

As used herein, the term "set screw" refers to a screw which is screwed into the side of the ground rod, e.g., through a drilled hole and presses against a conductive rod in a manner that holds the conductive rod in place.

DRAWINGS

Now referring to the drawings, FIG. 1 is a frontal view of the system of the present invention. In this view, ground rod 1 is a conductive metal and driven into the ground 7. Conductive rods 2*a* and 2*b* (in this embodiment copper rods, but any highly conductive material can be utilized), are inserted through precision drilled holes 3*a* and 3*b* in ground rod 1, hidden behind set screws. In this view, conductive rod 2*a* is four inches from the top of ground rod 1 and conductive rod 2*b* is one inch below conductive rod 2*a*. They are then held in place by set screws 4*a* and 4*b*, which are inserted into ground rod 1 and pressed against the ground rods holding them in place.

Grounding wires 5*a* and 5*b* are attached to each of the conductive rods with the opposite end connected to whatever needs grounding (not shown).

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A system for attaching grounding wires to a ground rod comprising:

a) a solid ground rod having a selected diameter;

b) one or more conductive rods with a selected diameter;

c) one hole through the diameter of the ground rod for each conductive rod utilized, wherein the diameter of each hole is less than the diameter of the ground rod and greater than the diameter of the conductive rod; and d) wherein the conductive rods are positioned through each of the holes in the diameter of the ground rod and each conductive rod is held in place by a set screw and wherein there is one or more grounding wires attached to one or more of the conductive rods.

2. The system for attaching grounding wires to a ground rod according to claim 1 wherein the ground rod and the conductive rods are made from a composition containing at least one of copper, iron, silver, stainless steel, and aluminum.

3. The system for attaching grounding wires to a ground rod according to claim 1 wherein the set screw is a bolt which passes through a side of the ground rod to the conductive rod.

* * * * *